US010600375B2

(12) United States Patent
Pan et al.

(10) Patent No.: US 10,600,375 B2
(45) Date of Patent: Mar. 24, 2020

(54) METHOD AND CIRCUIT FOR MODULATING EYE DIAGRAM AMPLITUDE, METHOD AND CIRCUITRY FOR DATA TRANSMISSION, AND DISPLAY DEVICE

(71) Applicants: BOE TECHNOLOGY GROUP CO., LTD., Beijing (CN); HEFEI BOE OPTOELECTRONICS TECHNOLOGY CO., LTD., Anhui (CN)

(72) Inventors: Yanjiao Pan, Beijing (CN); Yueyuan Zhang, Beijing (CN); Shancai Zhang, Beijing (CN); Dayu Zhang, Beijing (CN)

(73) Assignees: BOE TECHNOLOGY GROUP CO., LTD., Beijing (CN); HEFEI BOE OPTOELECTRONICS TECHNOLOGY CO., LTD., Anhui (CN)

( * ) Notice: Subject to any disclaimer, the term of this patent is extended or adjusted under 35 U.S.C. 154(b) by 123 days.

(21) Appl. No.: 15/750,885

(22) PCT Filed: Jul. 20, 2017

(86) PCT No.: PCT/CN2017/093655
§ 371 (c)(1),
(2) Date: Feb. 7, 2018

(87) PCT Pub. No.: WO2018/045831
PCT Pub. Date: Mar. 15, 2018

(65) Prior Publication Data

US 2019/0266964 A1 Aug. 29, 2019

(30) Foreign Application Priority Data

Sep. 8, 2016 (CN) ..... 2016 1 0811704

(51) Int. Cl.
*G09G 3/36* (2006.01)

(52) U.S. Cl.
CPC ..... *G09G 3/36* (2013.01); *G09G 2310/08* (2013.01)

(58) Field of Classification Search
CPC ..... G09G 3/3406; G09G 3/3413; G09G 3/36; G09G 2310/08; G09G 2320/0646
See application file for complete search history.

(56) References Cited

U.S. PATENT DOCUMENTS 6,820,979 B1 * 11/2004 Stark ..... A61B 3/112 351/206
8,890,946 B2 * 11/2014 Publicover ..... H04N 7/18 348/78

(Continued)

FOREIGN PATENT DOCUMENTS

CN 101075402 A 11/2007
CN 101605114 A 12/2009

(Continued)

OTHER PUBLICATIONS

"Analyzing Signals Using the Eye Diagram" by Breed, High Frequency Electronic, Nov. 2005, 3 pages.*

(Continued)

*Primary Examiner* — Joe H Cheng
(74) *Attorney, Agent, or Firm* — Westman, Champlin & Koehler, P.A.

(57) ABSTRACT

A method and a circuit for modulating an eye diagram amplitude, a method and a circuitry for data transmission, and a display device are provided. The method for modulating an eye diagram amplitude includes: an eye diagram amplitude setting step, including: setting, by a base eye diagram amplitude setting unit, a base eye diagram amplitude for a source driver; a preset differential signal outputting step, including: outputting, by a preset differential (Continued)

signal outputting unit, a preset differential signal to the source driver; a comparing step, including: comparing, by a comparing unit, a differential signal received by the source driver and the preset differential signal to obtain a comparison result; and a modulating step, including: modulating, by an eye diagram amplitude modulating unit, an eye diagram amplitude of the source driver based on the comparison result.

11 Claims, 2 Drawing Sheets

(56) References Cited

U.S. PATENT DOCUMENTS

| | | | | |
|---|---|---|---|---|
| 9,128,308 | B1 * | 9/2015 | Zortman | G02F 1/025 |
| 9,559,778 | B2 * | 1/2017 | McNicol | H04B 10/25137 |
| 2004/0081470 | A1 * | 4/2004 | Griffin | H04B 10/5561 398/188 |
| 2006/0125757 | A1 | 6/2006 | Kang et al. | |
| 2006/0256892 | A1 * | 11/2006 | Momtaz | H04L 25/061 375/317 |
| 2007/0268212 | A1 | 11/2007 | Han et al. | |
| 2009/0039860 | A1 * | 2/2009 | Suzuki | H04B 10/502 323/312 |
| 2009/0302935 | A1 | 12/2009 | Iwata et al. | |
| 2010/0253489 | A1 * | 10/2010 | Cui | G01S 13/723 340/425.5 |
| 2011/0176638 | A1 | 7/2011 | Davey et al. | |
| 2012/0081103 | A1 | 4/2012 | Wang | |
| 2013/0232372 | A1 * | 9/2013 | Sakamaki | G11C 5/04 713/500 |
| 2014/0270378 | A1 * | 9/2014 | Aimura | G06K 9/00805 382/103 |
| 2015/0092829 | A1 * | 4/2015 | Ali | H04L 25/03019 375/232 |

FOREIGN PATENT DOCUMENTS

| | | | |
|---|---|---|---|
| CN | 102014017 | A | 4/2011 |
| CN | 102681925 | | 9/2012 |
| CN | 102939721 | A | 2/2013 |
| CN | 202931466 | | 5/2013 |
| CN | 104699930 | | 6/2015 |
| CN | 106128406 | A | 11/2016 |
| EP | 1 434 347 | | 6/2004 |
| JP | 2006-322775 | | 11/2006 |
| JP | 2011-228799 | A | 11/2011 |

OTHER PUBLICATIONS

"The Eye Diagram: What is it it and why is it used?" by Herres, www.testandmeasurementtips.com, Aug. 16, 2016, 5 pages.*

Office Action from Chinese Patent Application No. 201610811704.6, dated Mar. 28, 2018, 11 pgs.

International Search Report and Written Opinion for International Application No. PCT/CN2017/093655, including English translation of Written Opinion, dated Oct. 19, 2017, 13 pages.

* cited by examiner

METHOD AND CIRCUIT FOR MODULATING EYE DIAGRAM AMPLITUDE, METHOD AND CIRCUITRY FOR DATA TRANSMISSION, AND DISPLAY DEVICE

CROSS-REFERENCE TO RELATED APPLICATION

This application is the U.S. national phase of PCT Application No. PCT/CN2017/093655, filed on Jul. 20, 2017, which claims a priority to Chinese Patent Application No. 201610811704.6 filed on Sep. 8, 2016, the disclosure of which is incorporated in its entirety by reference herein.

TECHNICAL FIELD

The present disclosure relates to the technical field of eye diagram amplitude modulation, in particular to a method and a circuit for modulating an eye diagram amplitude, a method and a circuitry for data transmission, and a display device.

BACKGROUND

In a driving circuitry of a liquid crystal display panel, the amplitude of a differential data signal outputted by a timing controller Tcon to a source driver is constant. However, due to layout, temperature, different load images, or the like, the amplitudes of the differential data signals in different groups arrived at the source driver are different, and the reception capacity of the source driver is different in different conditions, thus the requirement on the eye diagram amplitude of the received differential data signal varies with different conditions. If the eye diagram amplitude is set very large to meet the display requirement, the power consumption is increased, and if the eye diagram amplitude is set just large enough to meet the requirement, there is a risk of abnormal display in different conditions.

SUMMARY

The main object of the present disclosure is to provide a method and a circuitry for modulating an eye diagram amplitude, a method and a circuitry for data transmission, and a display device, to solve problems that the power consumption is increased if the eye diagram amplitude is set very large to meet different requirements, and there is a risk of abnormal display under different conditions if the eye diagram amplitude is set just large enough to meet the requirement, because the eye diagram amplitude cannot be dynamically modulated in the related art.

To solve the above problems, the present disclosure provides a method for modulating an eye diagram amplitude. The method includes: in an eye diagram amplitude modulating stage, an eye diagram amplitude setting step, including: setting, by a base eye diagram amplitude setting unit, a base eye diagram amplitude for a source driver;

a preset differential signal outputting step, including: outputting, by a preset differential signal outputting unit, a preset differential signal to the source driver;

a comparing step, including: comparing, by a comparing unit, a differential signal received by the source driver and the preset differential signal to obtain a comparison result; and a modulating step, including: modulating, by an eye diagram amplitude modulating unit, an eye diagram amplitude of the source driver based on the comparison result.

Optionally, in the case that the comparison result is a first comparison result indicating that the differential signal received by the source driver is identical to the preset differential signal, the modulating step further includes:

presetting a first eye diagram modulating step length; and increasing, by the eye diagram amplitude modulating unit, the eye diagram amplitude of the source driver by the first eye diagram modulating step length, proceeding to the preset differential signal outputting step and the comparing step until the comparison result turns into a second comparison result indicating that the differential signal received by the source driver is different from the preset differential signal, increasing by the eye diagram amplitude modulating unit, based on the second comparison result, the eye diagram amplitude of the source driver by the first eye diagram modulating step length, and stopping the step.

Optionally, in the case that the comparison result is the second comparison result indicating that the differential signal received by the source driver is different from the preset differential signal, the modulating step further includes:

presetting a second eye diagram modulating step length; and increasing, by the eye diagram amplitude modulating unit, the eye diagram amplitude of the source driver by the second eye diagram modulating step length, proceeding to the preset differential signal outputting step and the comparing step until the comparison result turns into a first comparison result indicating that the differential signal received by the source driver is identical to the preset differential signal, and stopping the step.

The present disclosure further provides a data transmitting method, which includes the above method for modulating an eye diagram amplitude.

Optionally, the base eye diagram amplitude setting unit, the preset differential signal outputting unit and the eye diagram amplitude modulating unit are arranged in a timing controller, and the comparison unit is arranged in the source driver. Subsequent to the modulating step included in the method for modulating an eye diagram amplitude is executed, the method for data transmission further includes:

outputting, by the timing controller, a data differential signal to the corresponding source driver, in a data differential signal outputting stage.

The present disclosure further provides a circuitry for modulating an eye diagram amplitude. The circuitry includes:

a base eye diagram amplitude setting unit, configured to set a base eye diagram amplitude for a source driver;

a preset differential signal outputting unit, configured to output a preset differential signal to the source driver;

a comparing unit, configured to compare a differential signal received by the source driver and the preset differential signal to obtain a comparison result; and an eye diagram amplitude modulating unit, configured to modulate an eye diagram amplitude of the source driver based on the comparison result.

Optionally, the base eye diagram amplitude setting unit is coupled to the source driver.

Optionally, the comparing unit is coupled to the preset differential signal outputting unit.

Optionally, the eye diagram amplitude modulating unit is coupled to the source driver and the comparison unit, and is further configured to transmit the modulated eye diagram amplitude to the source driver.

The present disclosure further provides a circuitry for data transmission, which includes a timing controller, a source driver and the above circuitry for modulating an eye diagram amplitude. The base eye diagram amplitude setting unit, the preset differential signal outputting unit and the eye diagram amplitude modulating unit of the circuitry for modulating an eye diagram amplitude, are arranged in the timing controller, and the comparison unit of the circuitry for modulating an eye diagram amplitude is arranged in the source driver.

The present disclosure further provides a display device, which includes the above circuitry for data transmission.

Compared with the related art, according to the method and circuitry for modulating an eye diagram amplitude, the method and circuitry for data transmission, and the display device in the present disclosure, the eye diagram amplitude of the source driver is modulated based on the comparison result which is obtained by the comparison unit and indicates whether the differential signal received by the source driver is identical to the preset differential signal. In such a manner, it is able to dynamically modulate the eye diagram amplitude, guarantee the data transmission and reception capability in various conditions, improve the display adversely affected by various data receiving errors, select the optimal amplitude and reduce the power consumption.

DETAILED DESCRIPTION

Technical solutions of embodiments of the present disclosure are illustrated clearly and completely in conjunction with drawings of the embodiments of the present disclosure. Apparently, the described embodiments are merely a few rather than all of the embodiments of the present disclosure. All other embodiments obtained by those skilled in the art based on the embodiments of the present disclosure without creative efforts shall fall within the protection scope of the present disclosure.

Figure 1:
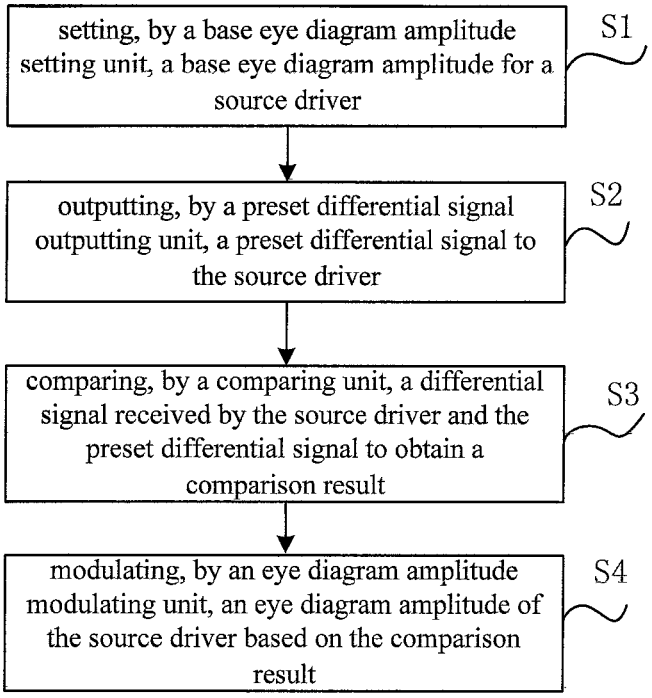
FIG. 1 is a flow chart of a method for modulating an eye diagram amplitude in at least one embodiment of the present disclosure.

Reference is made to FIG. 1, which illustrates a method for modulating an eye diagram amplitude in at least one embodiment of the present disclosure. The method includes: in an eye diagram amplitude modulating stage, an eye diagram amplitude setting step S1, including: setting, by a base eye diagram amplitude setting unit, a base eye diagram amplitude for a source driver;

a preset differential signal outputting step S2, including: outputting, by a preset differential signal outputting unit, a preset differential signal to the source driver;

a comparing step S3, including: comparing, by a comparing unit, a differential signal received by the source driver and the preset differential signal to obtain a comparison result; and a modulating step S4, including: modulating, by an eye diagram amplitude modulating unit, an eye diagram amplitude of the source driver based on the comparison result.

According to the method for modulating an eye diagram amplitude in at least one embodiment of the present disclosure, the eye diagram amplitude of the source driver is modulated based on the comparison result which is obtained by the comparison unit and indicates whether the differential signal received by the source driver is identical to the preset differential signal. In such a manner, it is able to dynamically modulate the eye diagram amplitude, guarantee the data transmission and reception capability in various conditions, improve the display adversely affected by various data receiving errors, select the optimal amplitude and reduce the power consumption.

Optionally, the base eye diagram amplitude may be 200 mV, and in an actual operation, the base eye diagram amplitude may be changed according to an amplitude of the differential signal, which is not limited herein.

For a digital signal, there are a variety of sequence combinations of a high level and a low level. Taking 3 bits for an example, there are eight kinds of combinations ranging from 000 to 111, and the eye diagram is formed by aligning enough of the above sequences with a certain reference point in the time domain, and superimposing waveforms of the sequences. For a test instrument, a clock signal is recovered from a signal to be tested, and an eye diagram is obtained by superimposing the signal based on the clock signal, and is displayed.

The eye diagram amplitude refers to a safe amplitude range of the differential signal received by an IC (Integrated Circuitry).

The above-mentioned source driver is the IC receiving the differential signal. In an actual operation, in the case that the amplitude of the differential signal received by the source driver is larger than 200 mV, the differential signal may be correct and correspond to the number "1". However, in the case that the amplitude of the differential signal arriving at the source driver drops below 200 mV due to layout, temperature, different load images, or the like, the differential signal received by the source driver may merely correspond to the number "0", and thus the sent differential signal is different from the differential signal received by the source driver, which results in a risk of abnormal display. In this case, the eye diagram amplitude is required to be improved. However, in the case that the eye diagram amplitude is set too high in the beginning, the power consumption is increased, although the display requirements under different conditions may be meet. Therefore, according to the method for modulating an eye diagram amplitude in at least one embodiment of the present disclosure, the eye diagram amplitude of the source driver is modulated based on the comparison result which is obtained by the comparison unit and indicates whether the differential signal received by the source driver is identical to the preset differential signal.

In some embodiments of the present disclosure, in the case that the comparison result is a first comparison result indicating that the differential signal received by the source driver is identical to the preset differential signal, the modulating step further includes:

presetting a first eye diagram modulating step length; and decreasing, by the eye diagram amplitude modulating unit, the eye diagram amplitude of the source driver by the first eye diagram modulating step length, proceeding to the preset differential signal outputting step and the comparing step until the comparison result turns into a second comparison result indicating that the differential signal received by the source driver is different from the preset differential signal, increasing by the eye diagram amplitude modulating unit, based on the second comparison result, the eye diagram amplitude of the source driver by the first eye diagram modulating step length, and stopping the step.

Optionally, the first eye diagram modulating step length may be 10 mV or 5 mV, and in an actual operation, the first eye diagram modulating step length may also be adjusted according to actual situations, which is not limited herein.

In the case that the differential signal received by the source driver is identical to the preset differential signal in the beginning, the eye diagram amplitude of the source driver may be decreased gradually until the comparison result obtained by the comparison unit turns into the second comparison result indicating that the differential signal received by the source driver is different from the preset differential signal, and then the eye diagram amplitude may be increased by one first eye diagram modulating step length to find the optimal eye diagram amplitude of the source driver. Therefore, it is able to guarantee the data transmission and reception capability in various conditions, improve the display adversely affected by various data receiving errors, and reduce the power consumption.

In some embodiments of the present disclosure, in the case that the comparison result is the second comparison result indicating that the differential signal received by the source driver is different from the preset differential signal, the modulating step further includes:

presetting a second eye diagram modulating step length; and increasing, by the eye diagram amplitude modulating unit, the eye diagram amplitude of the source driver by the second eye diagram modulating step length, proceeding to the preset differential signal outputting step and the comparing step until the comparison result turns into the first comparison result indicating that the differential signal received by the source driver is identical to the preset differential signal, and stopping the step.

Optionally, the second eye diagram modulating step length may be 10 mV or 5 mV, and in an actual operation, the second eye diagram modulating step length may also be adjusted according to actual situations, which is not limited herein.

In the case that the differential signal received by the source driver is different from the preset differential signal in the beginning, the eye diagram amplitude of the source driver may be increased gradually until the comparison result obtained by the comparison unit turns into the first comparison result indicating that the differential signal received by the source driver is identical to the preset differential signal, and the step is stopped. Therefore, it is able to guarantee the data transmission and reception capability in various conditions, improve the display adversely affected by various data receiving errors, and reduce the power consumption.

Hereinafter the method for modulating an eye diagram amplitude of the present disclosure will be described in some embodiments.

Figure 2:
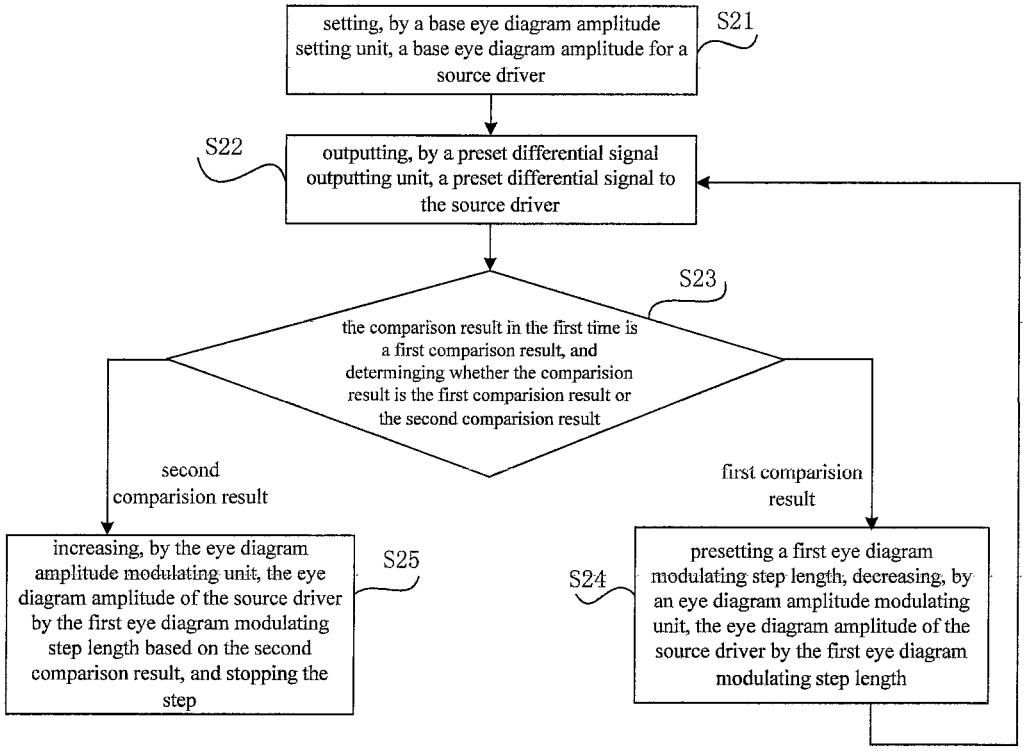
FIG. 2 is a flow chart of a method for modulating an eye diagram amplitude in at least one embodiment of the present disclosure.

Reference is made to FIG. 2, which illustrates a method for modulating an eye diagram amplitude in at least one embodiment of the present disclosure. The method includes:

an eye diagram amplitude setting step S21, including: setting, by a base eye diagram amplitude setting unit, a base eye diagram amplitude for a source driver;

a preset differential signal outputting step S22, including: outputting, by a preset differential signal outputting unit, a preset differential signal to the source driver;

a comparing step S23, including: comparing, by a comparing unit, a differential signal received by the source driver and the preset differential signal to obtain a comparison result, where the comparison result in the first time is a first comparison result indicating that the differential signal received by the source driver is identical to the preset differential signal, proceeding to a first modulating step S24 in the case that the comparison result is the first comparison result, and proceeding to a second modulating step S25 in the case that the comparison result is a second comparison result indicating that the differential signal received by the source driver is different from the preset differential signal;

the first modulating step S24, including: presetting a first eye diagram modulating step length, decreasing, by an eye diagram amplitude modulating unit, the eye diagram amplitude of the source driver by the first eye diagram modulating step length, and proceeding to the preset differential signal outputting step S22; and the second modulating step S25, increasing, by the eye diagram amplitude modulating unit, the eye diagram amplitude of the source driver by the first eye diagram modulating step length based on the second comparison result, and stopping the step.

According to the method for modulating an eye diagram amplitude in at least one embodiment of the present disclosure, in the case that the comparison result of the comparison unit in the first time is the first comparison result indicating that the differential signal received by the source driver is identical to the preset differential signal, the eye diagram amplitude of the source driver needs to be decreased gradually until the comparison result obtained by the comparison unit turns into the second comparison result indicating that the differential signal received by the source driver is different from the preset differential signal, then the eye diagram amplitude of the source driver may be increased by one first eye diagram modulating step length to find the optimal eye diagram amplitude of the source driver. Therefore, it is able to guarantee the data transmission and reception capability in various conditions, improve the display adversely affected by various data receiving errors, and reduce the power consumption.

Figure 3:
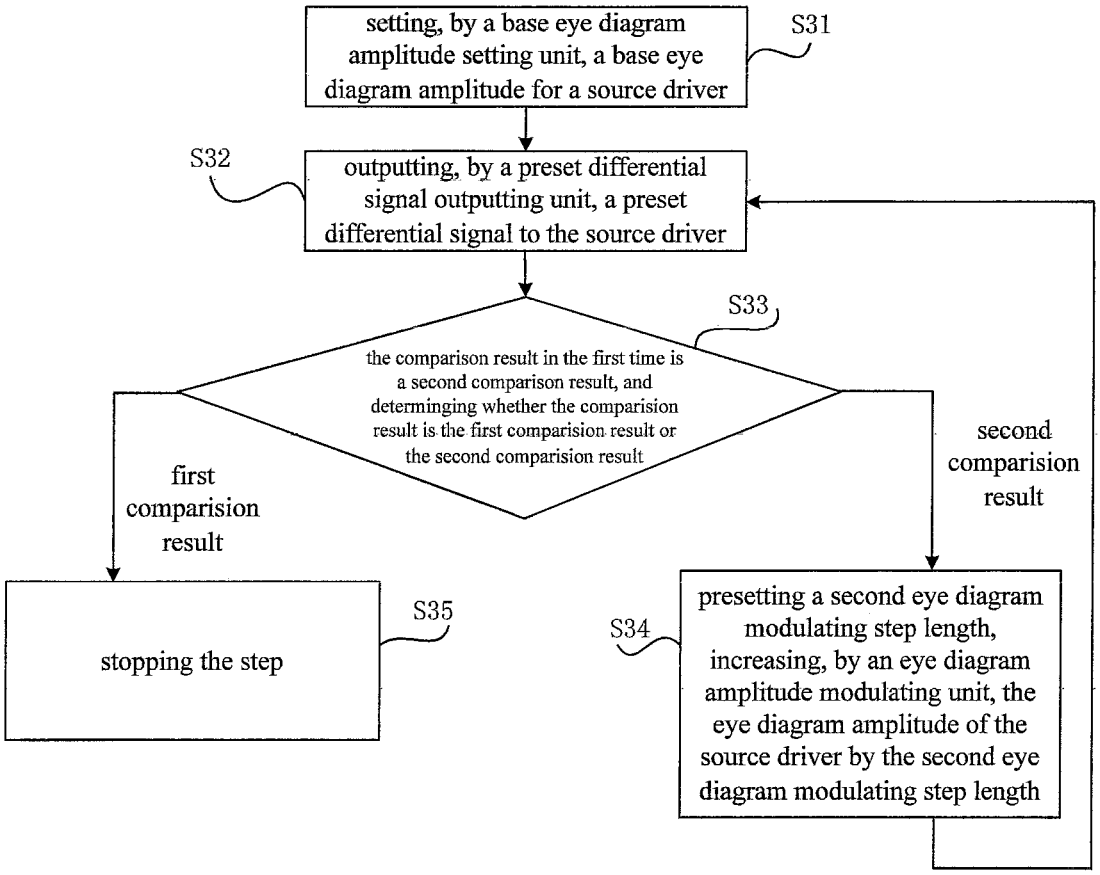
FIG. 3 is a flow chart of a method for modulating an eye diagram amplitude in at least one embodiment of the present disclosure.

Reference is made to FIG. 3, which illustrates a method for modulating an eye diagram amplitude in at least one embodiment of the present disclosure. The method includes:

an eye diagram amplitude setting step S31, including: setting, by a base eye diagram amplitude setting unit, a base eye diagram amplitude for a source driver;

a preset differential signal outputting step S32, including: outputting, by a preset differential signal outputting unit, a preset differential signal to the source driver;

a comparing step S33, including: comparing, by a comparing unit, a differential signal received by the source driver and the preset differential signal to obtain a comparison result, where the comparison result in the first time is a second comparison result indicating that the differential signal received by the source driver is different from the preset differential signal, proceeding to a first modulating step S34 in the case that the comparison result turns into the second comparison result, and proceeding to a stopping step S35 in the case that the comparison result is a first comparison result indicating that the differential signal received by the source driver is identical to the preset differential signal;

the first modulating step S34, including: presetting a second eye diagram modulating step length, increasing, by an eye diagram amplitude modulating unit, the eye diagram amplitude of the source driver by the second eye diagram modulating step length, and proceeding to the preset differential signal outputting step S32; and the stopping step S35, stopping the step.

According to the method for modulating an eye diagram amplitude in at least one embodiment of the present disclosure, in the case that the comparison result of the comparison unit in the first time is the second comparison result indicating that the differential signal received by the source driver is different from the preset differential signal, the eye diagram amplitude of the source driver needs to be increased gradually until the comparison result obtained by the comparison unit turns into the first comparison result indicating that the differential signal received by the source driver is identical to the preset differential signal, and the step is stopped. Therefore, it is able to guarantee the data transmission and reception capability in various conditions, improve the display adversely affected by various data receiving errors, and reduce the power consumption.

A method for data transmission is provided in at least one embodiment of the present disclosure, which includes the above method for modulating an eye diagram amplitude.

In method for data transmission in at least one embodiment of the present disclosure, a timing controller is applied to transmit the differential signal to the source driver. According to the method for modulating an eye diagram amplitude, the eye diagram amplitude is modulated to be an optimal eye diagram amplitude before transmitting the differential signal.

In an actual operation, the base eye diagram amplitude setting unit, the preset differential signal outputting unit and the eye diagram amplitude modulating unit are arranged in the timing controller, and the comparison unit is arranged in the source driver. Subsequent to the modulating step, the method for data transmission further includes:

outputting, by the timing controller, a data differential signal to the corresponding source driver, in a data differential signal outputting stage.

In the method for data transmission in at least one embodiment of the present disclosure, the timing controller starts formally transmitting the data differential signal to the source driver, after the eye diagram amplitude is dynamically modulated.

A circuitry for modulating an eye diagram amplitude is provided in at least one embodiment of the present disclosure. The circuitry includes:

a base eye diagram amplitude setting unit, configured to set a base eye diagram amplitude for a source driver;

a preset differential signal outputting unit, configured to output a preset differential signal to the source driver;

a comparing unit, configured to compare a differential signal received by the source driver and the preset differential signal to obtain a comparison result; and an eye diagram amplitude modulating unit, configured to modulate an eye diagram amplitude of the source driver based on the comparison result.

A circuitry for data transmission is provided in at least one embodiment of the present disclosure. The circuitry includes a timing controller, a source driver and the above circuitry for modulating an eye diagram amplitude. The base eye diagram amplitude setting unit, the preset differential signal outputting unit and the eye diagram amplitude modulating unit of the circuitry for modulating an eye diagram amplitude are arranged in the timing controller, and the comparison unit of the circuitry for modulating an eye diagram amplitude is arranged in the source driver.

The circuitry for data transmission according to the at least one embodiment of the present disclosure includes the timing controller, a source driver and the circuitry for modulating an eye diagram amplitude. The circuitry for modulating an eye diagram amplitude includes a base eye diagram amplitude setting unit, a preset differential signal outputting unit, a comparing unit and an eye diagram amplitude modulating unit. The base eye diagram amplitude setting unit, the preset differential signal outputting unit and the eye diagram amplitude modulating unit are arranged in the timing controller, and the comparing unit is arranged in the source driver. The base eye diagram amplitude setting unit is coupled to the source driver and configured to set a base eye diagram amplitude for the source driver. The preset differential signal outputting unit is configured to output a preset differential signal to the source driver. The comparing unit is coupled to the preset differential signal outputting unit and configured to compare a differential signal received by the source driver and the preset differential signal to obtain a comparison result. The eye diagram amplitude modulating unit is coupled to the source driver and the comparison unit, and is configured to modulate an eye diagram amplitude of the source driver based on the comparison result and transmit the modulated eye diagram amplitude to the source driver.

A display device is provided in at least one embodiment of the present disclosure, which includes the above circuitry for data transmission.

The circuitry for data transmission of the present disclosure will be described below through a specific embodiment.

Figure 4:
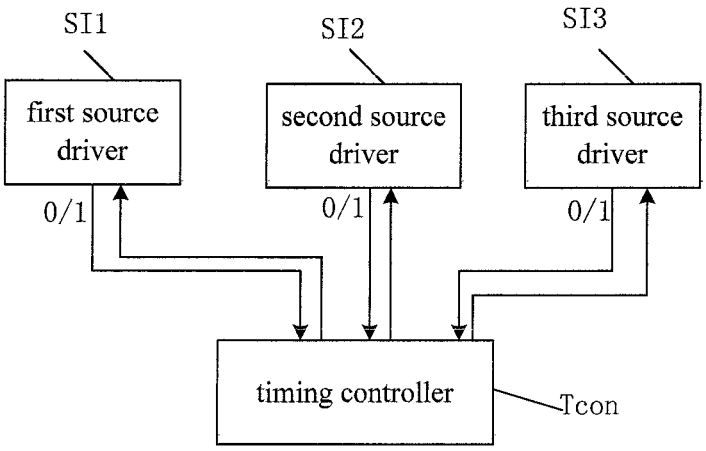
FIG. 4 is a schematic diagram of a circuitry for modulating an eye diagram amplitude in at least one embodiment of the present disclosure.

As shown in FIG. 4, an eye diagram amplitude modulating stage is set before a timing controller Tcon formally outputs respectively data differential signals to three source drivers, including a first source driver SI1, a second source driver SI2 and a third source driver SI3. In the eye diagram amplitude modulating stage, the eye diagram amplitudes of the data differential signals are divided into several levels, and then transmitted to the three source drivers, respectively, and the optimal level is selected through a feedback training signal to set an output eye diagram amplitude.

Firstly, the base eye diagram amplitude V0 (for example, 200 mV) is set according to the basic requirement of each of the source drives, and a level amplitude is set, for example, 10 mV/level. The level amplitude is an eye diagram modulating step length.

Secondly, during the eye diagram amplitude modulating stage, the base eye diagram amplitude V0 is transmitted to each of the source drivers. A comparison signal indicating whether the received preset differential signal is correct is fed back to Tcon by each of the source drivers. In the case that the comparison signal received by Tcon from one of the source drivers is 0, it is indicated that data received by the source driver is correct. In the case that the comparison signal received by Tcon from one of the source drivers is 1, it is indicated that the data received by the source driver is incorrect, that is, the eye diagram amplitude does not meet the requirement. In this case, the preset eye diagram amplitude is changed by a register for setting the eye diagram amplitude in Tcon to enable the outputted eye diagram amplitude to be increased by one level, that is, the level eye diagram amplitude is changed to V0+10 mV, and then the modulated eye diagram amplitude is outputted and transmitted to the source driver.

Similarly, in the case that the eye diagram amplitude is set too large, the level of the set eye diagram amplitude may be decreased progressively. In the case that the comparison signal received by Tcon is 1, which indicates that the data is incorrect, the previous level of the eye diagram amplitude is selected as the optimal level.

In addition, the calculation can be performed by Tcon according to an ambient temperature and the content of a load image to recommend a level of the eye diagram amplitude. After comparing, in the case that the set eye diagram amplitude is too large, the level is automatically decreased to the original level, and in the case that the set eye diagram amplitude is too small, the level is automatically increased. In such a manner, it is able to dynamically modulate the eye diagram amplitude, guarantee the data transmission and reception capability in various conditions, improve the display adversely affected by various data receiving errors, select the optimal amplitude and reduce the power consumption.

The above descriptions are merely alternative embodiments of the present disclosure. It should be noted that, some improvements and modifications can be made by those skilled in the art without departing from the principle of the present disclosure, and these improvements and modifications shall also fall within the scope of the present disclosure

What is claimed is:

1. A method for modulating an eye diagram amplitude, comprising: in an eye diagram amplitude modulating stage, an eye diagram amplitude setting step, comprising: setting, by a base eye diagram amplitude setting unit, a base eye diagram amplitude for a source driver;

a preset differential signal outputting step, comprising: outputting, by a preset differential signal outputting unit, a preset differential signal to the source driver;

a comparing step, comprising: comparing, by a comparing unit, a differential signal received by the source driver and the preset differential signal to obtain a comparison result; and a modulating step, comprising: modulating, by an eye diagram amplitude modulating unit, an eye diagram amplitude of the source driver based on the comparison result;

wherein in the case that the comparison result is a first comparison result indicating that the differential signal received by the source driver is identical to the preset differential signal, the modulating step further comprises:

presetting a first eye diagram modulating step length; and decreasing, by the eye diagram amplitude modulating unit, the eye diagram amplitude of the source driver by the first eye diagram modulating step length, proceeding to the preset differential signal outputting step and the comparing step until the comparison result turns into a second comparison result indicating that the differential signal received by the source driver is different from the preset differential signal, increasing by the eye diagram amplitude modulating unit, based on the second comparison result, the eye diagram amplitude of the source driver by, the first eye diagram modulating step length, and stopping the step.

2. A method for data transmission, comprising the method for modulating an eye diagram amplitude according to claim 1.

3. The method for data transmission according to claim 2, wherein the base eye diagram amplitude setting unit, the preset differential signal outputting unit and the eye diagram amplitude modulating unit are arranged in a timing controller, the comparison unit is arranged in the source driver, and subsequent to the modulating step, the method further comprises:

outputting, by the timing controller, a data differential signal to the corresponding source driver, in a data differential signal outputting stage.

4. A circuitry for modulating an eye diagram amplitude, applied to perform the method according to claim 1, comprising:

a base eye diagram amplitude setting unit, configured to set a base eye diagram amplitude for a source driver;

a preset differential signal outputting unit, configured to output a preset differential signal to the source driver;

a comparing unit, configured to compare a differential signal received by the source driver and the preset differential signal to obtain a comparison result; and an eye diagram amplitude modulating unit, configured to modulate an eye diagram amplitude of the source driver based on the comparison result.

5. The circuitry for modulating an eye diagram amplitude according to claim 4, wherein the base eye diagram amplitude setting unit is coupled to the source driver.

6. The circuitry for modulating an eye diagram amplitude according to claim 4, wherein the comparing unit is coupled to the preset differential signal outputting unit.

7. The circuitry for modulating an eye diagram amplitude according to claim 4, wherein the eye diagram amplitude modulating unit is coupled to the source driver and the comparison unit, and is further configured to transmit the modulated eye diagram amplitude to the source driver.

8. A circuitry for data transmission, comprising a timing controller, a source driver and the circuitry for modulating an eye diagram amplitude according to claim 4, wherein the base eye diagram amplitude setting unit, the preset differential signal outputting unit and the eye diagram amplitude modulating unit of the circuitry for modulating an eye diagram amplitude are arranged in the timing controller, and the comparison unit of the circuitry for modulating an eye diagram amplitude is arranged in the source driver.

9. A display device comprising the circuitry for data transmission according to claim 8.

10. A method for modulating an eye diagram amplitude, comprising: in an eye diagram amplitude modulating stage, an eye diagram amplitude setting step, comprising: setting, by a base eye diagram amplitude setting unit, a base eye diagram amplitude for a source driver;

a preset differential signal outputting step, comprising: outputting, by a preset differential signal outputting unit, a preset differential signal to the source driver;

a comparing step, comprising: comparing, by a comparing unit, a differential signal received by the source driver and the preset differential signal to obtain a comparison result; and a modulating step, comprising: modulating, by an eye diagram amplitude modulating unit, an eye diagram amplitude of the source driver based on the comparison result;

wherein in the case that the comparison result is a second comparison result indicating that the differential signal received by the source driver is different from the preset differential signal, the modulating step further comprises:

presetting a second eye diagram modulating step length; and increasing, by the eye diagram amplitude modulating unit, the eye diagram amplitude of the source driver by the second eye diagram modulating step length, proceeding to the preset differential signal outputting step and the comparing step until the comparison result turns into a first comparison result indicating that the differential signal received by the source driver is identical to the preset differential signal, and stopping the step.

11. A circuitry for modulating an eye diagram amplitude, applied to perform the method according to claim 10.

* * * * *